US009745865B2

(12) United States Patent
Lefebvre et al.

(10) Patent No.: US 9,745,865 B2
(45) Date of Patent: Aug. 29, 2017

(54) DEVICE FOR AXIAL LOCKING OF A MOVING PART WITH RESPECT TO A REFERENCE PART

(71) Applicant: SNECMA, Paris (FR)

(72) Inventors: Olivier Lefebvre, Melun (FR); Philippe Bourdin, Saint Just (FR); Marc Jolly, Alfortville (FR)

(73) Assignee: SNECMA, Paris (FR)

( * ) Notice: Subject to any disclaimer, the term of this patent is extended or adjusted under 35 U.S.C. 154(b) by 635 days.

(21) Appl. No.: 14/163,390

(22) Filed: Jan. 24, 2014

(65) Prior Publication Data

US 2014/0212274 A1 Jul. 31, 2014

(30) Foreign Application Priority Data

Jan. 25, 2013 (FR) ..... 13 50645

(51) Int. Cl.

| | |
|---|---|
| ***F01D 25/28*** | (2006.01) |
| ***F01D 5/02*** | (2006.01) |
| ***F01D 17/02*** | (2006.01) |
| ***F01D 21/00*** | (2006.01) |

(52) U.S. Cl.

CPC ..... *F01D 25/28* (2013.01); *F01D 5/026* (2013.01); *F01D 17/02* (2013.01); *F01D 21/003* (2013.01)

(58) Field of Classification Search

CPC ..... F16B 39/10; F01D 5/066; F01D 5/026; F01D 25/28; F01D 21/003; F01D 17/02

USPC ..... 464/182; 411/204, 217, 219; 416/244 A, 416/61; 415/118

See application file for complete search history.

(56) References Cited

U.S. PATENT DOCUMENTS 3,602,535 A * 8/1971 Behning ..... F01D 5/026 403/118
3,622,185 A * 11/1971 Rosan, Sr. ..... F16D 1/06 403/259
7,811,052 B2 * 10/2010 Guihard ..... F01D 5/026 415/122.1

(Continued)

FOREIGN PATENT DOCUMENTS

DE 102009035346 2/2011
EP 1 357 254 10/2003

(Continued)

OTHER PUBLICATIONS

Search Report and Written Opinion as issued for French Patent Application No. 1350645, dated Jul. 18, 2013.

*Primary Examiner* — Phutthiwat Wongwian
*Assistant Examiner* — Jason T Newton
(74) *Attorney, Agent, or Firm* — Pillsbury Winthrop Shaw Pittman LLP

(57) ABSTRACT

A device for axial locking of a moving part in rotation with respect to a reference part, includes a downstream locking wedge provided with lugs laid out such that the downstream locking wedge can be placed in: a first angular position in which the downstream locking wedge may be translated axially with respect to the moving part, a second angular position in which the lugs axially immobilize the downstream locking wedge with respect to the moving part; an upstream locking wedge able to prevent the rotation of the downstream locking wedge with respect to the moving part; and a stop segment able to immobilize axially the upstream locking wedge against the downstream locking wedge.

10 Claims, 4 Drawing Sheets

(56) References Cited

U.S. PATENT DOCUMENTS

| | | | | |
|---|---|---|---|---|
| 8,312,613 | B2 * | 11/2012 | Marshall | E21B 4/14 29/456 |
| 8,579,538 | B2 * | 11/2013 | Juh | F01D 5/066 403/359.5 |
| 8,920,129 | B2 * | 12/2014 | Harbin | F16B 39/02 416/244 R |
| 9,022,684 | B2 * | 5/2015 | Coffin | F16D 1/033 403/296 |

FOREIGN PATENT DOCUMENTS

| | | |
|---|---|---|
| EP | 1 813 769 | 8/2007 |
| FR | 2 978 218 | 1/2013 |

* cited by examiner

DEVICE FOR AXIAL LOCKING OF A MOVING PART WITH RESPECT TO A REFERENCE PART

CROSS REFERENCES TO RELATED APPLICATIONS

This application claims priority to French Patent Application No. 1350645, filed Jan. 25, 2013, the entire content of which is incorporated herein by reference in its entirety.

FIELD

The present invention relates to a device for axial locking of a moving part with respect to a reference part, and particularly an axial locking device of a measuring stick provided with a connector with respect to a turbine shaft. The present invention also relates to a turbomachine provided with such an axial locking device.

BACKGROUND

Certain turbomachines comprise remote measuring devices making it possible to collect data relative to the operation of the turbomachine. Such a remote measuring device is generally arranged at the level of the fan disk and a measuring stick is inserted into the turbine shaft so as to accommodate the cables that make it possible to make the data transit from this remote measuring device to a data processing centre. To do so, the measuring stick comprises a proximal end provided with a connector intended to be connected with a connector of the remote measuring device.

The part of the turbomachine in which is located the remote measuring device and its connector is not indexed angularly with the part of the turbomachine in which is located the measuring stick and its connector, such that it is useful to be able to turn the connector of the measuring stick to be able to connect it with the connector of the remote measuring device. The connector of the measuring stick must thus be moveable in rotation to be able to be connected with the connector of the remote measuring device. Furthermore, to be able to connect easily the connector of the measuring stick with the connector of the remote measuring device, it would be beneficial to lock axially the connector of the measuring stick with respect to the turbine shaft.

SUMMARY

An aspect of the invention aims to overcome the drawbacks of the prior art by proposing a locking device making it possible to lock axially a moving part, particularly a connector of a measuring stick, with respect to a reference part, and particularly a part integral with a turbine shaft or a turbine shaft, while leaving the moving part free in rotation with respect to the reference part.

Another aspect of the invention also aims to propose an axial locking device without angular locking that can be used when the free space between the moving part and the reference part is restricted.

To do so, according to a first embodiment of the invention, an axial locking device of a moving part with respect to a reference part is proposed, an annular cavity being formed between the reference part and the moving part, the reference part extending along a reference axis, the reference part comprising a groove and a support shoulder extending transversally to the reference axis, the moving part comprising a transversal slot delimited by a downstream edge and an upstream edge, the upstream edge comprising circumferential openings, the axial locking device comprising:

- A downstream locking wedge able to be inserted into the annular cavity, the downstream locking wedge being provided with lugs laid out such that the downstream locking wedge can be placed in:
  - a first angular position in which the downstream locking wedge can be translated axially through the circumferential openings of the upstream edge;
  - a second angular position in which the lugs axially immobilise the downstream locking wedge in the slot axially resting against the downstream edge and the support shoulder;
- An upstream locking wedge able to be inserted into the annular cavity until it comes into axial abutment against the downstream locking wedge, the upstream locking wedge being laid out to prevent the rotation of the downstream locking wedge in the slot when the upstream locking wedge is in axial abutment against the downstream locking wedge;
- A stop segment able to be inserted into the annular cavity and to be inserted into the groove so as to immobilise axially the upstream locking wedge against the downstream locking wedge.

Thus, the axial locking device makes it possible to immobilise axially the moving part with respect to the reference part in a position in which the downstream edge of the moving part is aligned with the support shoulder of the reference part without preventing the rotation of the moving part with respect to the reference part. To do so, the first angular position of the downstream locking wedge makes it possible to insert, in translating it axially around the moving part, the downstream locking wedge through the openings of the upstream edge in the slot of the moving part, since in this position the lugs of the downstream locking wedge are facing openings of the upstream edge. The second angular position of the downstream locking wedge makes it possible for its part to lock axially the downstream locking wedge in the slot, axially resting against the downstream edge of the slot and the support shoulder of the reference part, since in this position the lugs of the downstream locking wedge are no longer facing openings of the upstream edge and consequently they can no longer be translated axially through the openings of the upstream edge. The upstream locking wedge makes it possible to maintain the downstream locking wedge in the second angular position when it is axially resting against the upstream locking wedge. The stop segment for its part makes it possible to lock axially the upstream locking wedge against the downstream locking wedge such that the upstream locking wedge immobilises in rotation the downstream locking wedge. Moreover, when the stop segment is in the groove, it is itself immobilised axially, such that it locks axially the upstream locking wedge and the downstream locking wedge between the groove and the support shoulder. The moving part, which is immobilised axially with respect to the axial locking device is thus also immobilised axially with respect to the reference part. Furthermore, nothing prevents the axial locking device from turning inside the reference part, such that the moving part can also for its part turn inside the reference part.

The locking device according to an embodiment of the invention may also have one or more of the following characteristics taken individually or according to any technically possible combinations thereof.

According to an embodiment, the downstream locking wedge has a main body from which lugs project radially towards the interior. The lugs may have a complementary shape to the openings of the upstream edge such that they may be translated through the openings of the upstream edge.

According to an embodiment, the upstream locking wedge comprises complementary lugs, each complementary lug being able to be inserted:

- into one of the circumferential openings of the upstream edge and
- between two consecutive lugs of the downstream locking wedge
- so as to prevent angular movements of the downstream locking wedge in the slot.

In an embodiment, the complementary lugs also have a complementary shape to the openings of the upstream edge such that, when they are inserted into the openings of the upstream edge, they fit together perfectly in these openings and they prevent angular movements of the moving part with respect to the reference part.

Beneficially, the upstream locking wedge has a main annular body from which the complementary lugs project radially towards the interior.

In an embodiment, the stop segment has a diameter at rest, the stop segment being able to be deformed elastically to have a transition diameter less than the diameter at rest. Thus, to insert the stop segment between the moving part and the reference part, the stop segment is deformed such that it has a transition diameter. Then, once the stop segment is located facing the groove it is left to return to its initial shape so that it recovers its diameter at rest. The stop segment thus penetrates into the groove.

A second embodiment of the invention relates to an assembly immobilised axially comprising:

- a reference part extending along a reference axis, the reference part comprising a groove and a support shoulder extending transversally with respect to the reference axis,
- a moving part comprising a transversal slot delimited by a downstream edge and an upstream edge, the upstream edge comprising circumferential openings, an annular cavity being formed between the reference part and the moving part;
- the moving part being immobilised axially with respect to the reference part such that the downstream edge of the moving part is aligned axially with the support shoulder of the reference part by a locking device according to the first embodiment of the invention, the downstream locking wedge being inserted into the slot of the moving part in the second angular position, the downstream locking wedge being axially resting against the support shoulder and against the downstream edge, the upstream locking wedge being axially resting against the downstream locking wedge so as to prevent the rotation of the downstream locking wedge in the slot, the stop segment being inserted into the groove of the reference part so as to be immobilised axially.

The assembly according to the second embodiment of the invention may also comprise one or more of the following characteristics taken individually or according to any of the technically possible combinations thereof:

- The moving part is surrounded at least partially by the reference part;
- The moving part is cylindrical;
- The reference part is cylindrical;
- The wedge formed by the upstream locking wedge axially resting against the downstream locking wedge has a width along the reference axis equal to the distance along the reference axis between the groove and the support shoulder;
- the reference part is integral with a turbine shaft into which is inserted the moving part, the reference part comprising:
  - a nut screwed onto the turbine shaft, the nut comprising legs extending along the reference axis, the groove being formed in the legs of the nut,
  - anti-rotation device laid out to prevent the rotation of the nut with respect to the turbine shaft, the anti-rotation device comprising the transversal shoulder;
- the moving part is formed by a connector integral with a measuring stick inserted into the turbine shaft.

A third embodiment of the invention relates to a turbomachine comprising an assembly according to the second embodiment of the invention.

A fourth embodiment of the invention relates to a method of axial locking a moving part with respect to a reference part surrounding the moving part, the reference part extending along a reference axis, the reference part comprising a groove and a support shoulder extending transversally to the reference axis, the moving part comprising a transversal slot delimited by a downstream edge and an upstream edge, the upstream edge comprising circumferential openings, thanks to an axial locking device according to the first embodiment of the invention, the method comprising the following steps:

- A step of alignment of the downstream edge of the moving part with the support shoulder of the reference part;
- A step of insertion of the downstream locking wedge into the slot of the reference part until the downstream locking wedge is in axial abutment against the downstream edge of the moving part and against the support shoulder of the reference part, the downstream locking wedge being in the first angular position during this insertion step;
- A step of rotation of the downstream locking wedge so that it is in the second angular position;
- A step of insertion of the upstream locking wedge around the moving part until it is in axial abutment against the downstream locking wedge;
- A step of elastic deformation of the stop segment such that it has a transition diameter;
- A step of insertion of the stop segment around the moving part until it is placed facing the groove;
- A step of releasing the stresses exerted on the stop segment such that it recovers its original diameter at rest and that it penetrates into the groove.

BRIEF DESCRIPTION OF DRAWINGS

Other characteristics and advantages of the invention will become clear on reading the detailed description that follows, with reference to the appended figures, which illustrate.

For greater clarity, identical or similar elements are marked by identical reference signs in all of the figures.

DETAILED DESCRIPTION

Figure 1:
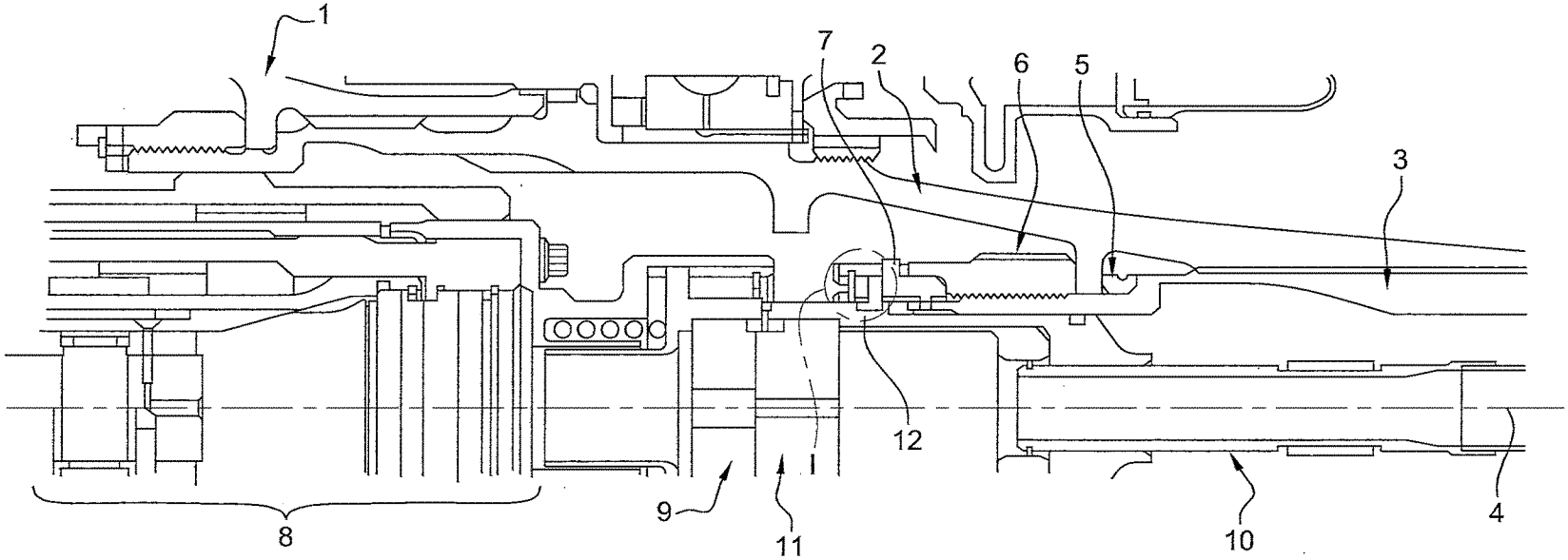
FIG. 1, a partial sectional view of a turbomachine according to an embodiment of the invention.

FIG. 1 represents a part of a turbomachine according to an embodiment of the invention. This turbomachine comprises particularly:

- a fan disk 1,
- a low pressure compressor shaft 2,
- a low pressure turbine shaft 3 inserted into the low pressure compressor shaft 2.

The low pressure turbine shaft 3 and the low pressure compressor shaft 2 extend along a reference axis 4.

In this document, "axial" designates an element that extends parallel to the reference axis 4, and "transversal" designates an element that extends perpendicularly to the reference axis 4.

The low pressure turbine shaft 3 is immobilised axially with respect to the low pressure compressor shaft 2 thanks to an adjustment wedge 5.

The low pressure turbine shaft comprises an end on which is screwed a nut 6.

The turbomachine also comprises an anti-rotation device 7 laid out to prevent the rotation of the nut with respect to the low pressure turbine shaft 3. The anti-rotation device 7 used is for example those described in the document FR no 1156707. The nut 6 and the anti-rotation device 7 form a reference part 16 integral with the low pressure turbine shaft 3. The reference part 16 is thus immobilised axially and in rotation with respect to the low pressure turbine shaft 3.

The turbomachine also comprises a remote measuring device 8 installed at the level of the fan disk 1. Said remote measuring device 8 makes it possible to collect data relative to the turbomachine. The remote measuring device 8 comprises a remote measurement connector 9.

The turbomachine also comprises a measuring stick 10 inserted into the low pressure turbine shaft 3. The measuring stick 10 has a proximal end provided with a connector 11. The connector 11 of the measuring stick 10 is connected to the remote measurement connector 9 of the remote measuring device so as to transmit the data from the remote measuring device 8 to the exterior of the turbomachine.

The turbomachine also comprises a locking device 12 according to an embodiment of the invention. This locking device 12 makes it possible to immobilise axially the connector 11 of the measuring stick 10 with respect to the reference part 16, and thus with respect to the low pressure turbine shaft 3, while leaving the connector 11 free in rotation with respect to the reference part 16 and thus with respect to the low pressure turbine shaft 3. The connector 11 is also called moving part 20 hereafter.

The moving part 20 has on its outer surface a slot 17 comprising a downstream edge 18 and an upstream edge 19. The slot 17 extends over the whole circumference of the moving part 20. The downstream edge 18 and the upstream edge 19 extend perpendicularly with respect to the reference axis 4. In an embodiment, the upstream edge has circumferential openings 27 spread out regularly on its periphery.

The reference part 16 forms a cylinder that surrounds the moving part 20, in such a way as to form an annular cavity 21 between the moving part 20 and the reference part 16.

The reference part 16 further comprises a groove 22. In an embodiment, the groove 22 is formed in legs 23 of the nut 7, each leg 23 extending axially. The reference part 16 also comprises a support shoulder 24 extending transversally with respect to the reference axis 4.

The locking device 12 will now be described in detail with reference to FIGS. 2 to 9. It makes it possible to immobilise axially the moving part 20 with respect to the reference part 16 in a position such that the downstream edge 18 is aligned axially with respect to the support shoulder 24.

To do so, the locking device 12 comprises:

- a downstream locking wedge 13;
- an upstream locking wedge 14;
- a stop segment 15.

Figure 2:
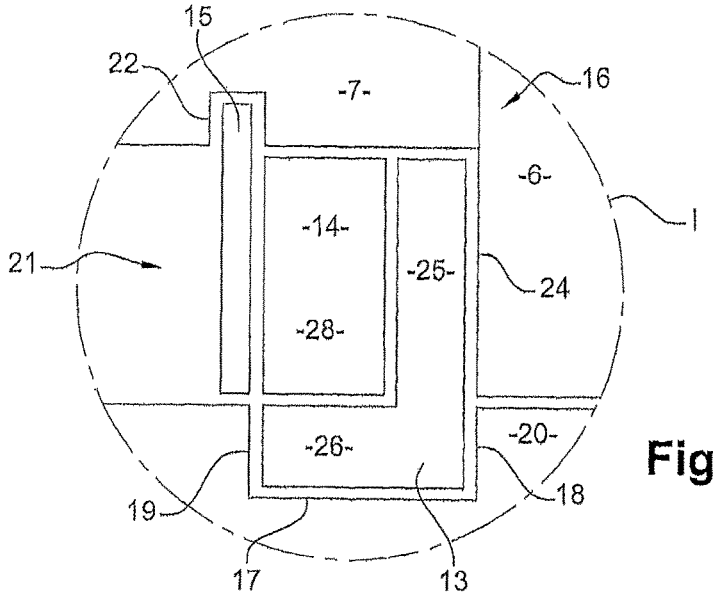
FIG. 2, an enlargement of part I of the turbomachine of FIG. 1.
Figure 4:
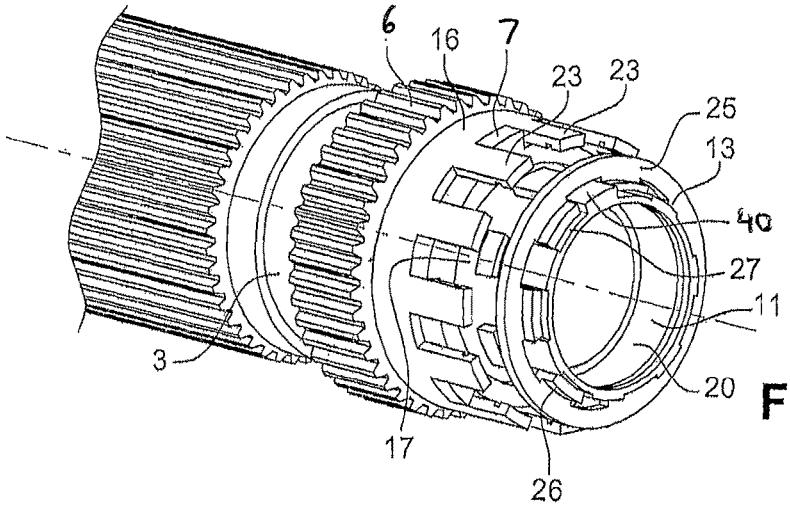

The downstream locking wedge 13 comprises an annular body 25 from which lugs 26 project radially towards the interior of the annular body 25. As shown in FIGS. 2 and 4, the lugs 26 also project axially. In an embodiment, the annular body 25 of the downstream locking wedge 13 has an inner diameter adjusted to the outer diameter of the moving part 20 such that the downstream locking wedge can be inserted around the moving part 20. The lugs 26 have dimensions less than or equal to those of the circumferential openings 27 of the upstream part 40 such that the lugs 26 can be inserted through the circumferential openings 27 of the upstream edge. Moreover, the lugs 26 are spread out on the peripheral of the main body 25 such that the downstream locking wedge 13 can be translated axially through the circumferential openings 27 of the upstream part 40 so as to be inserted into the slot 17 of the moving part 20.

The upstream locking wedge 14 also comprises an annular body 28 from which complementary lugs 29 project. In an embodiment, the annular body 28 of the upstream locking wedge 14 has an inner diameter adjusted to the outer diameter of the moving part 20 such that the upstream locking wedge 14 can be inserted around the moving part 20. In an embodiment, the complementary lugs 29 have dimensions adjusted to those of the circumferential openings 27 of the upstream part 40 such that the complementary lugs 29 can be inserted into the circumferential openings 27, but that they fill at the same time all the space left between two consecutive lugs 26 of the downstream locking wedge 13 such that the upstream locking wedge 14 prevents the rotation of the downstream locking wedge 13 when the complementary lugs 29 of the upstream locking wedge 14 are inserted between the lugs 26 of the downstream locking wedge 13.

In an embodiment, the stop segment 15 has a cylindrical or helicoidal shape. The stop segment 15 has at rest a rest diameter substantially equal to that of the groove 22. Nevertheless, the stop segment 15 may be deformed elastically so that it has a transition diameter less than the rest diameter. This transition diameter is such that the stop segment may be inserted into the annular cavity 21 defined between the moving part 20 and the reference part 16. Then, when the stop segment is located facing the groove 22 it can recover its initial shape and thus its diameter at rest, which enables it to penetrate into the groove 22.

A method of putting in place the axial locking device described previously so as to immobilise axially the moving part 20 with respect to the reference part 16 will now be described with reference to FIGS. 3 to 9.

Figure 3:
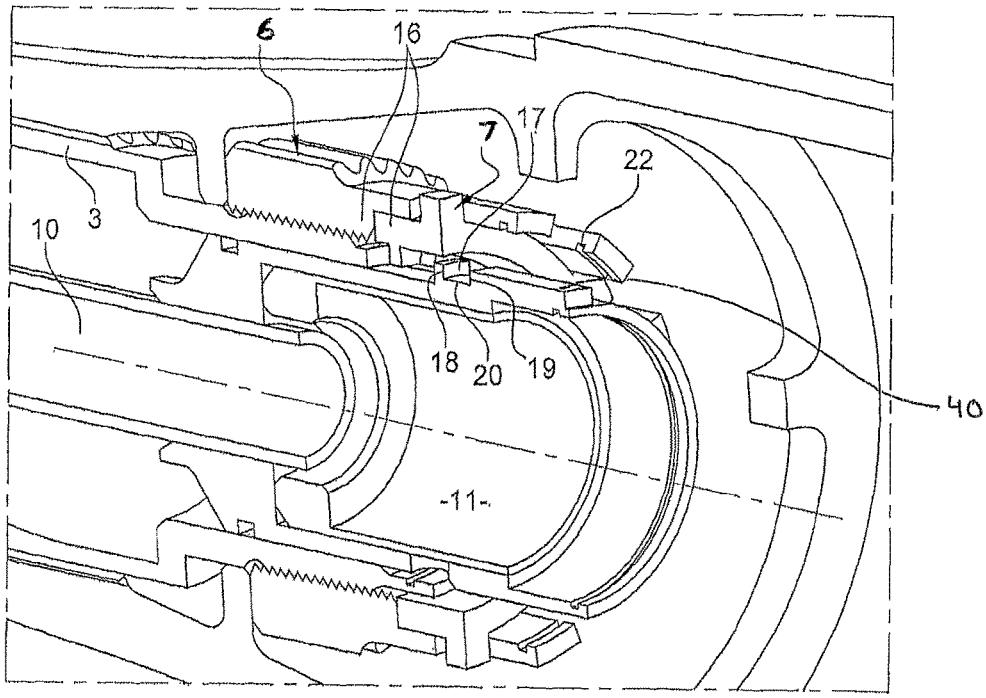
FIGS. 3 to 9, perspective views of a part of the turbomachine of FIG. 2 during the placement of a locking device according to an embodiment of the invention.

FIG. 3 represents the assembly comprising the reference part 16 and the moving part 20 to be immobilised axially in the absence of the locking device. The moving part 20 is firstly positioned axially with respect to the reference part 16 such that the downstream edge 18 of the slot 17 of the moving part 20 is aligned axially with the support shoulder 24 of the reference part 16.

With reference to FIG. 4, the downstream locking wedge 13 is firstly placed in a first angular position. The first angular position corresponds to a position in which the lugs 26 of the downstream locking wedge 13 are placed facing circumferential openings 27 of the moving part 20 such that the downstream locking wedge 13 can be inserted around the moving part 20 and translated axially along this moving part 20 until it comes into axial abutment against the downstream edge 18 of the moving part 20.

Figure 5:
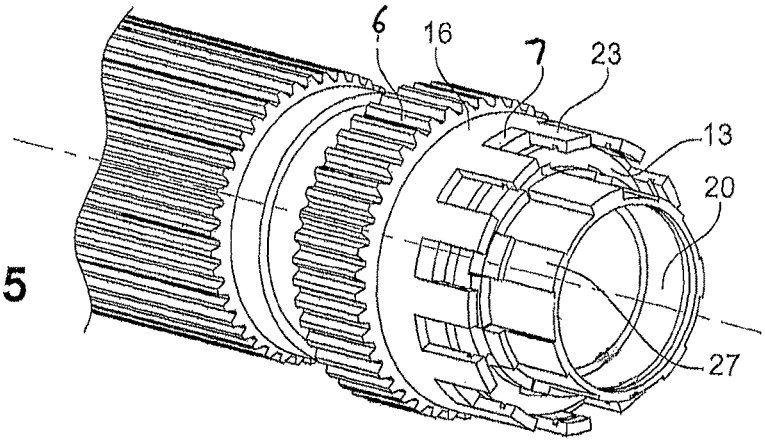

The downstream locking wedge 13 is inserted into the moving part 20 (FIG. 4) and translated along this moving part 20 until it comes into axial abutment against the downstream edge 18 of the slot 17 (FIG. 5). In this position, the downstream locking wedge 13 is in axial abutment both:

against the downstream edge 18 of the slot 17 of the moving part 20 and against the support shoulder 24 of the reference part 16.

Figure 6:
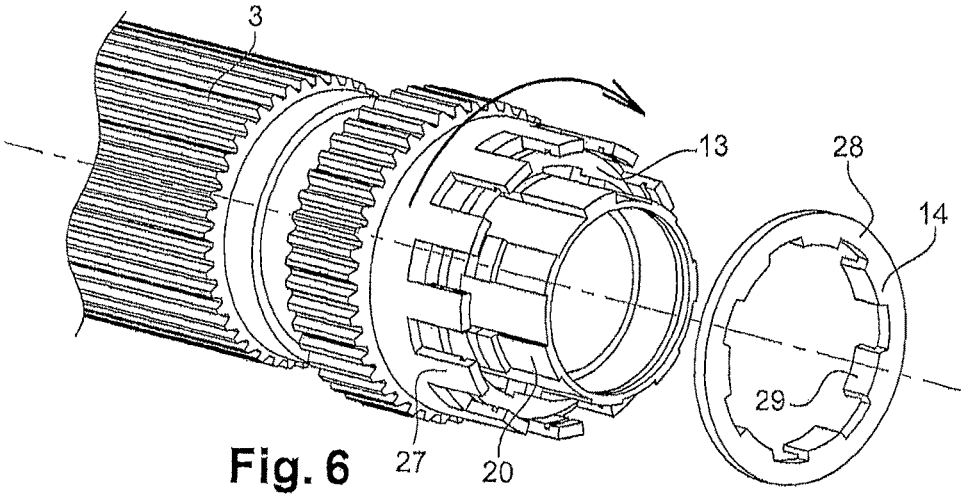
Figure 7:
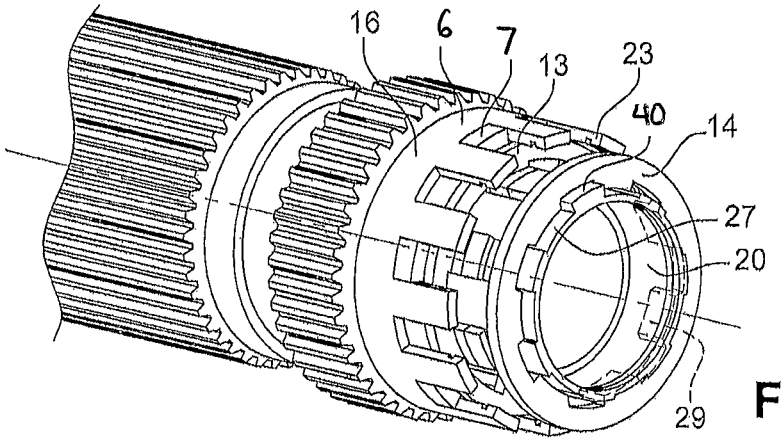

The downstream locking wedge 13 is then turned such that it is placed in a second angular position (FIG. 6). The second angular position corresponds to a position in which the lugs 26 of the downstream locking wedge 13 are offset with respect to the circumferential openings 27 of the moving part 20 such that the downstream locking wedge 13 can no longer clear the upstream edge 19 of the slot 17. The downstream locking wedge 13 is thus locked axially in the slot 17.

Figure 8:
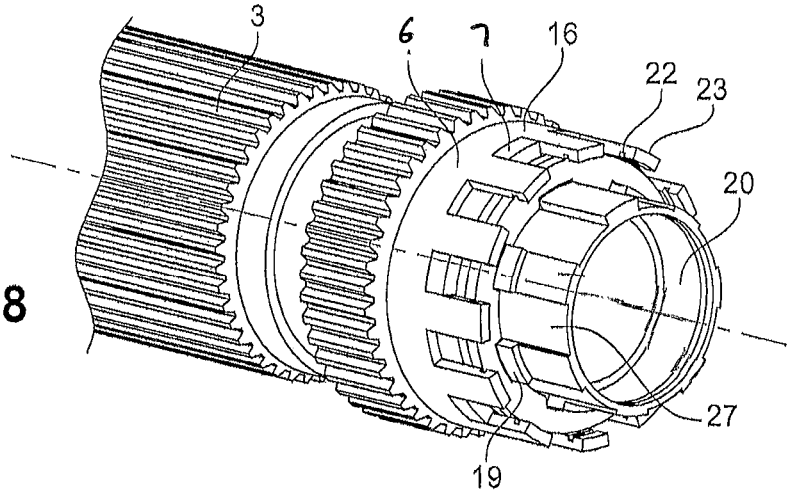

The upstream locking wedge 14 is then inserted around the moving part 20 (FIG. 7) and translated axially until it comes into axial abutment against the downstream locking wedge 13 (FIG. 8). Each complementary lug 29 of the upstream locking wedge is then inserted into a circumferential opening 27 of the moving part 20 and between two lugs 26 of the downstream locking wedge 13 such that the upstream locking wedge 14 prevents the rotation of the downstream locking wedge 13. The complementary lugs 27 should thus have a sufficient length along the reference axis so that they extend both at least in part along the axial walls of the circumferential openings and at least in part along the axial walls of the lugs of the downstream locking wedge 13. The downstream locking wedge 13 can then no longer return to the first angular position such that it is locked in the slot 17.

Figure 9:
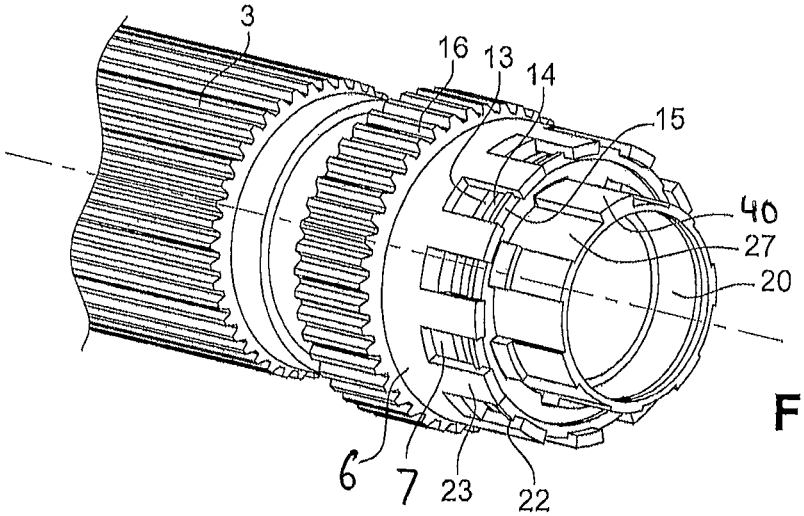

The stop segment 15 is then deformed elastically so that it has a transition diameter, then inserted into the annular cavity 21 until it is located facing the groove 22 (FIG. 9). The stop segment 15 is then again deformed so that it recovers its rest diameter. The stop segment 15 then penetrates into the groove 22. The stop segment 15 is then in axial abutment against the upstream locking wedge 14. The upstream locking wedge and the downstream locking wedge are thus immobilised axially between the support shoulder 24 and the stop segment 15.

The downstream locking wedge 13, the upstream locking wedge 14, and the stop segment 15 are free to turn in the reference part 16 such that the moving part 20 is also free to turn in the reference part 16. The moving part 20 is thus immobilised axially with respect to the reference part 16 while being free in rotation.

Naturally, the invention is not limited to the embodiments described with reference to the figures and variants could be envisaged without going beyond the scope of the invention. Thus, in this embodiment, the reference part comprises the nut and the anti-rotation means, put it could be possible to envisage that it is constituted directly of the turbine shaft. Furthermore, in this embodiment, the reference part surrounds the moving part, but it could be envisaged that it is the opposite: in this case, the slot would be formed in the moving part that surrounds the reference part, whereas the groove would be formed in the reference part that would be inside the moving part. In this case, the upstream and downstream locking wedges would be identical to those described previously, with the exception that the lugs and the complementary lugs would project towards the exterior of the annular bodies, instead of projecting towards the interior. Moreover, the stop segment has been described as having one transition diameter, but it could have several of them.

The invention claimed is:

1. An axial locking device for axial locking of a moving part with respect to a reference part, an annular cavity being defined between the reference part and the moving part, the reference part extending along a reference axis, the reference part comprising a groove and a support shoulder extending transversally to the reference axis, the moving part comprising a transversal slot delimited by a downstream edge and an upstream edge, the upstream edge comprising circumferential openings, the axial locking device comprising:

a downstream locking wedge constructed to be inserted into the annular cavity, the downstream locking wedge being provided with lugs laid out such that the downstream locking wedge can be placed in:

a first angular position in which the downstream locking wedge may be translated axially through the circumferential openings of the upstream edge, and a second angular position in which the lugs immobilize axially the downstream locking wedge in the transversal slot axially resting against the downstream edge and the support shoulder;

an upstream locking wedge constructed to be inserted into the annular cavity until it comes into axial abutment against the downstream locking wedge, the upstream locking wedge being laid out to prevent the rotation of the downstream locking wedge in the transversal slot when the upstream locking wedge is in axial abutment against the downstream locking wedge, a stop segment constructed to be inserted into the annular cavity and to be inserted into the groove so as to immobilize axially the upstream locking wedge against the downstream locking wedge.

2. The axial locking device according to claim 1, wherein the downstream locking wedge has an annular body from which the lugs project radially.

3. The axial locking device according to claim 1, wherein the upstream locking wedge comprises complementary lugs, each complementary lug being constructed to be inserted: into one of the circumferential openings of the upstream edge, and between two consecutive lugs of the downstream locking wedge so as to prevent angular movements of the downstream locking wedge in the transversal slot.

4. The axial locking device according to claim 1, wherein the upstream locking wedge has an annular body from which the complementary lugs project radially.

5. The axial locking device according to claim 1, wherein the stop segment has a diameter at rest, the stop segment being able to be deformed elastically to have a transition diameter less than the diameter at rest.

6. An assembly immobilized axially comprising:

a reference part extending along a reference axis, the reference part comprising a groove and a support shoulder extending transversally with respect to the reference axis;

a moving part comprising a transversal slot delimited by a downstream edge and an upstream edge, the upstream edge comprising circumferential openings;

an annular cavity being formed between the reference part and the moving part;

a downstream locking wedge constructed to be inserted into the annular cavity, the downstream locking wedge being provided with lugs laid out such that the downstream locking wedge can be placed in:

a first angular position in which the downstream locking wedge may be translated axially through the circumferential openings of the upstream edge, and a second angular position in which the lugs immobilize axially the downstream locking wedge in the transversal slot while axially resting against the downstream edge and the support shoulder;

an upstream locking wedge constructed to be inserted into the annular cavity until it comes into axial abutment against the downstream locking wedge, the upstream locking wedge being laid out to prevent the rotation of the downstream locking wedge in the transversal slot when the upstream locking wedge is in axial abutment against the downstream locking wedge;

a stop segment constructed to be inserted into the annular cavity and to be inserted into the groove so as to immobilize axially the upstream locking wedge against the downstream locking wedge;

wherein the moving part is immobilized axially with respect to the reference part such that the downstream edge of the moving part is aligned axially with the support shoulder of the reference part by the downstream locking wedge being inserted into the transversal slot of the moving part in the second angular position, such that the downstream locking wedge axially rests against the support shoulder and against the downstream edge, by the upstream locking wedge axially resting against the downstream locking wedge so as to prevent the rotation of the downstream locking wedge in the transversal slot, and by the stop segment being inserted into the groove of the reference part so as to be immobilized axially.

7. The assembly according to claim 6, wherein the upstream locking wedge axially resting against the downstream locking wedge has a width along the reference axis equal to the distance along the reference axis between the groove and the support shoulder.

8. The assembly according to claim 7, wherein the reference part is integral with a turbine shaft into which is inserted the moving part, the reference part comprising: a nut screwed onto the turbine shaft, the nut comprising legs extending along the reference axis, the groove being formed in the legs of the nut, an anti-rotation device laid out to prevent the rotation of the nut with respect to the turbine shaft, the anti-rotation device comprising a transversal shoulder.

9. The assembly according to claim 8, wherein the moving part is formed by a connector integral with a measuring stick inserted into the turbine shaft.

10. A turbomachine comprising the assembly according to claim 6.

* * * * *